US006863122B2

(12) United States Patent
St. Pierre et al.

(10) Patent No.: US 6,863,122 B2
(45) Date of Patent: Mar. 8, 2005

(54) HEAT EXCHANGER WITH NESTED FLANGE-FORMED PASSAGEWAY

(75) Inventors: Michel St. Pierre, Hamilton (CA); Nicola Frederic Vecchiola, Hamilton (CA); Joseph English, Calgary (CA); Kenneth Abels, Oakville (CA)

(73) Assignee: Dana Canada Corporation, Oakville (CA)

( * ) Notice: Subject to any disclaimer, the term of this patent is extended or adjusted under 35 U.S.C. 154(b) by 129 days.

(21) Appl. No.: 10/425,157

(22) Filed: Apr. 29, 2003

(65) Prior Publication Data

US 2004/0040697 A1 Mar. 4, 2004

(30) Foreign Application Priority Data

May 3, 2002 (CA) ..... 2384712

(51) Int. Cl.[7] ..... F28F 3/04
(52) U.S. Cl. ..... 165/167; 165/916
(58) Field of Search ..... 165/167, 166, 165/916

(56) References Cited

U.S. PATENT DOCUMENTS

| | | | | |
|---|---|---|---|---|
| 2,677,531 A | | 5/1954 | Hock, Sr. et al. | |
| 4,708,199 A | | 11/1987 | Yogo et al. | |
| 4,742,866 A | | 5/1988 | Yamanaka et al. | |
| 4,872,578 A | | 10/1989 | Fuerschbach et al. | |
| 4,892,136 A | | 1/1990 | Ichihara et al. | |
| 5,078,209 A | | 1/1992 | Kerkman et al. | |
| 5,146,980 A | | 9/1992 | Le Gauyer | |
| 5,154,225 A | | 10/1992 | Armbruster et al. | |
| 5,179,999 A | | 1/1993 | Meekins et al. | |
| 5,513,702 A | | 5/1996 | Tajima et al. | |
| 5,538,593 A | * | 7/1996 | Sakai et al. | 165/167 |
| 5,765,632 A | | 6/1998 | Gire | |
| 5,954,126 A | | 9/1999 | Armbruster | |
| 6,182,748 B1 | * | 2/2001 | Brost et al. | 165/167 |
| 6,199,626 B1 | | 3/2001 | Wu et al. | |

FOREIGN PATENT DOCUMENTS

| | | |
|---|---|---|
| EP | 0 108 377 | 5/1984 |
| JP | 39-25540 | 9/1939 |

* cited by examiner

*Primary Examiner*—Leonard R. Leo
(74) *Attorney, Agent, or Firm*—Dykema Gossett PLLC

(57) ABSTRACT

A heat exchanger has oil core plates and coolant core plates disposed in alternating, stacked relationship. Flow passages are provided between adjacent plates, so that the oil flow passages alternate with the coolant flow passages, and the oil can flow from an oil inlet opening of each oil plate, and through the oil flow passage to an oil outlet opening, and coolant can flow from a coolant inlet opening of each coolant plate through the coolant flow passage to a coolant outlet opening. The oil inlet openings are adjacent one end of the plates, and the oil outlet openings are spaced from the oil inlet openings, with a passageway for flow of the oil between upstanding bosses of the coolant plates on opposed sides of each oil plate and extending from a gap in an upstanding flange of the oil plate to the oil outlet opening.

24 Claims, 6 Drawing Sheets

HEAT EXCHANGER WITH NESTED FLANGE-FORMED PASSAGEWAY

This application claims priority to Canadian Patent Application No. 2,384,712 filed May 3, 2002.

FIELD OF THE INVENTION

This invention relates to a heat exchanger which is of the type comprising a plurality of plates disposed in stacked relationship, with the plates having aligned inlet openings for a first fluid to be cooled by a second fluid, aligned outlet openings for the first fluid, aligned inlet openings for the second fluid, and aligned outlet openings for the second fluid, the plates being so formed that between adjacent plates there is a flow passage, with the alternate flow passages in the stack of plates permitting flow of the first fluid therethrough from the first fluid inlet openings to the first fluid outlet openings but preventing the flow of the second fluid to these flow passages, and with the remaining alternate flow passages permitting flow of the second fluid therethrough from the second fluid inlet openings to the second fluid outlet openings but preventing the flow of the first fluid to these remaining flow passages. One example of such a heat exchanger is that disclosed in U.S. Pat. No. 2,677,531 issued on May 4, 1954 to Hock, Sr., et al.

BACKGROUND OF THE INVENTION

It is a primary object of the present invention to provide a heat exchanger of the above-described type which is economical to manufacture and which has a high operating efficiency in that the heat transfer through the plates forming the flow passages for the first fluid between the first fluid inlet openings and the first fluid outlet openings and forming the flow passages for the second fluid between the second fluid inlet openings and the second fluid outlet openings is optimised, thereby achieving a high rate of heat transfer from the first fluid to the second fluid.

SUMMARY OF THE INVENTION

In accordance with the present invention there is provided a heat exchanger which comprises a plurality of first fluid core plates, and a plurality of second fluid core plates. Each plate has a first fluid inlet opening adjacent one end of the plate, a first fluid outlet opening spaced from the first fluid inlet opening towards an opposed end of the plate, a second fluid inlet opening, and a second fluid outlet opening, with the second fluid inlet and outlet openings being adjacent said opposed end of the plate. Each first fluid core plate has an inwardly inclined, upstanding flange surrounding the first fluid inlet opening in the plate except for a portion thereof adjacent said one end of the plate at which gap means is provided in the flange. The first fluid outlet opening in the plate extends to adjacent said opposed end of the plate, and a further inwardly inclined, upstanding flange surrounds the first fluid outlet opening in the plate except adjacent said opposed end of the plate at which gap means is provided in said further flange. Upstanding bosses in the plate are disposed on opposite sides of the first fluid outlet opening in the plate, with the second fluid inlet and outlet openings being provided in said bosses. Each second fluid core plate has an upstanding boss with inwardly inclined side walls with the first fluid inlet opening being provided in this boss. A further upstanding boss has the first fluid outlet opening provided therein with this boss extending to adjacent said opposed end of the plate, and with said further upstanding boss having inwardly inclined side walls. The first fluid core plates and the second fluid core plates are in alternating stacked relationship, with the upstanding flange of the first fluid inlet opening of each first fluid core plate being in sealed nested contact with the side walls of the boss of the adjacent second fluid core plate in which the first fluid inlet opening is provided. Said further upstanding flange surrounding the first fluid outlet opening of each first fluid core plate is in sealed nested contact with the further upstanding boss having the first fluid outlet opening of the adjacent second fluid core plate with a passageway for flow of the first fluid between said further upstanding boss of the second fluid core plate on one side of the first fluid core plate and said further upstanding boss of the second fluid core plate on the other side of the first fluid core plate and extending from the gap means in said further upstanding flange of the first fluid core plate to the first fluid outlet opening, and the upstanding bosses in which the second fluid inlet and outlet openings are provided in each first fluid core plate being in sealed contact with the adjacent second fluid core plate. The periphery of each first fluid core plate is sealed to the periphery of the adjacent second fluid core plate. Flow passages are provided between adjacent ones of the plates, with the flow passage between each first fluid core plate and the upwardly adjacent second fluid core plate being a first fluid flow passage and the flow passage between each second fluid core plate and the upwardly adjacent first core plate being a second fluid flow passage, so that the first fluid flow passages alternate with the second fluid flow passages, and the first fluid can flow from the first fluid inlet opening of each first fluid core plate through the gap means in the associated upstanding flange, through the first fluid flow passage, and through the gap means in the further upstanding flange and said passageway to the first fluid outlet opening, and second fluid can flow from the second fluid inlet opening of each second fluid core plate through the second fluid flow passage to the second fluid outlet opening.

It will be appreciated that alternatively the first fluid may flow in the reverse direction through the first fluid flow passage in which case the first fluid outlet openings in the plates would function as first fluid inlet openings, and the first fluid inlet openings in the plates would function as first fluid outlet openings.

The first fluid may be oil which could be, for example, natural or synthetic engine oil, transmission or power steering oil, with the second fluid being a coolant for cooling the oil in the heat exchanger, and hereinafter the first and second fluids are so referred to. Alternatively, at least one of the first and second fluids could be, for example, water, deionised water, heavy water, or refrigerant.

BRIEF DESCRIPTION OF THE DRAWINGS

In order that the invention may be more clearly understood and more readily carried into effect, the same will now, by way of example, be more fully described with reference to the accompanying drawings in which.

DETAILED DESCRIPTION OF PREFERRED EMBODIMENTS

Figure 1:
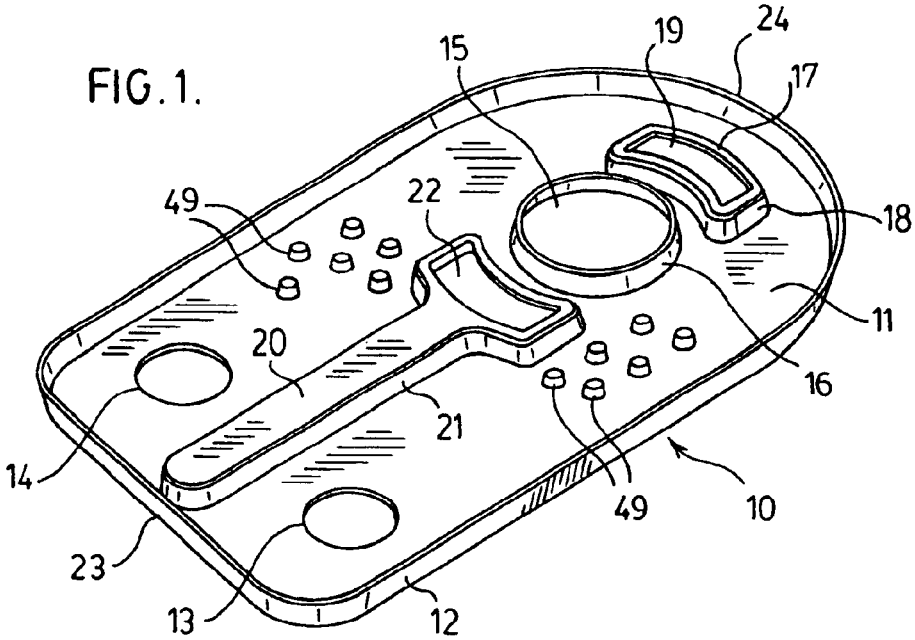
FIG. 1 is an isometric view of a coolant core plate of a heat exchanger according to a preferred embodiment of the invention.
Figure 3:
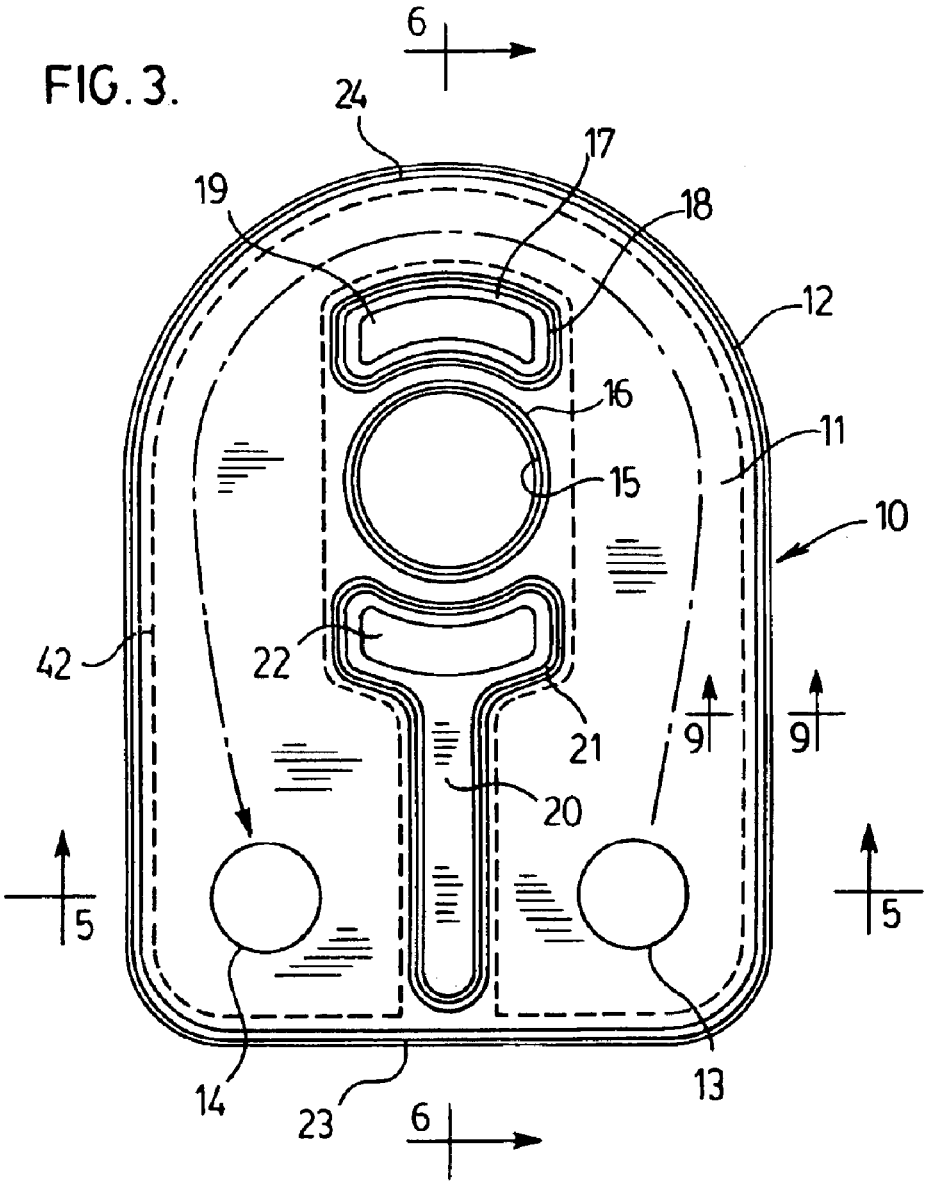
FIG. 3 is a plan view of the coolant core plate shown in FIG. 1.

With particular reference to FIGS. 1 and 3 of the drawings, each coolant core plate 10 comprises a planar base 11 which, in the preferred embodiment of the invention, is surrounded at its periphery by an upstanding flange 12, this flange 12 being outwardly inclined in the direction from the base 11. The base 11 has a coolant inlet opening 13 and a coolant outlet opening 14 together with, in the preferred embodiment shown in the drawings, a further opening 15 surrounded by an upstanding flange 16 which is inwardly inclined in the direction from the base 11. The base 11 also has an upstanding boss 17, the side walls 18 of which are inwardly inclined in the direction from the base 11 and the upper face of which has an oil inlet opening 19. Furthermore, the base 11 has a further upstanding boss 20 which is preferably of approximately T-shape, with the side walls 21 of this boss 20 being inwardly inclined in the direction from the base 11 and an oil outlet opening 22 being provided in the upper face of the head of the T-shaped boss 20. The flange 16 surrounding the opening 15 is between and closely spaced from the bosses 17 and 20, with the coolant inlet opening 13 and the coolant outlet opening 14 being adjacent an end 23 of the plate 10 opposed to the end 24 thereof adjacent to which the oil inlet opening 19 is provided and being on opposite sides of the boss 20 which extends to closely adjacent said opposed end 23 of the plate 10.

Figure 2:
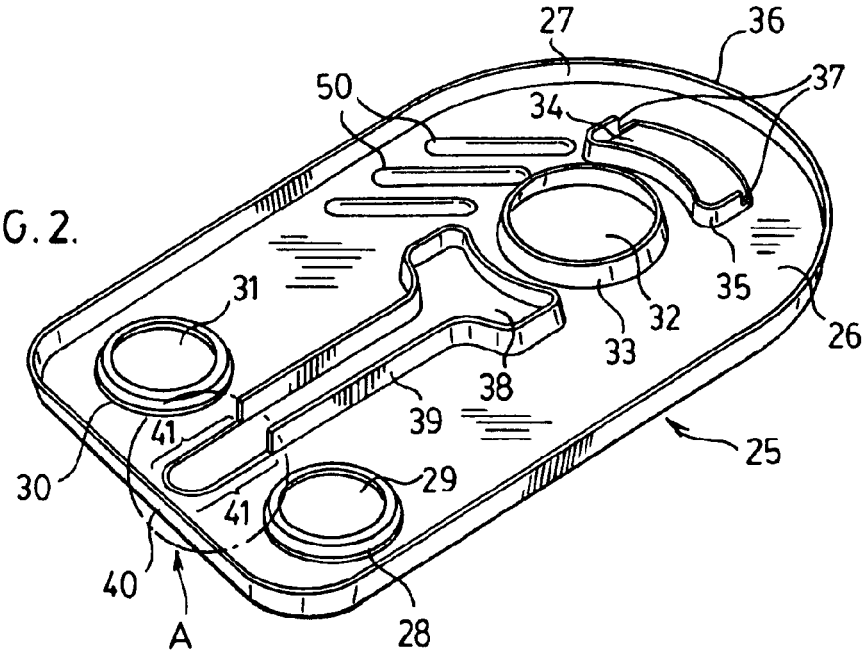
FIG. 2 is an isometric view of an oil core plate of the heat exchanger according to a preferred embodiment of the invention.
Figure 4:
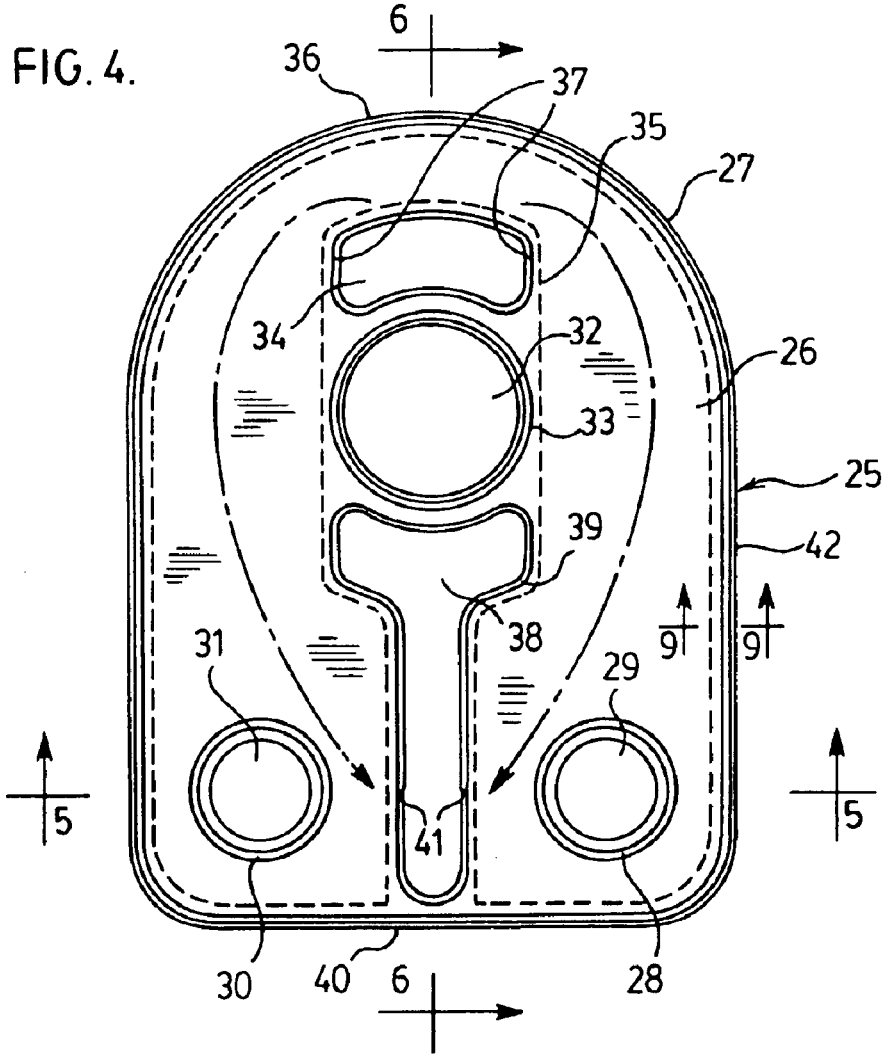
FIG. 4 is a plan view of the oil core plate shown in FIG. 2.

Referring to FIGS. 2 and 4, each oil core plate 25 comprises a planar base 26 which, in the preferred embodiment of the invention, is surrounded at its periphery by an upstanding flange 27 outwardly inclined in the direction from the base 26. The base 26 also has an upstanding boss 28 having a coolant inlet opening 29 in the upper face thereof, together with a further upstanding boss 30 having a coolant outlet opening 31 in the upper face thereof. An opening 32 surrounded by an upstanding flange 33 which is inwardly inclined in the direction from the base 26 is also provided, together with an oil inlet opening 34 which is surrounded by an upstanding flange 35 except adjacent the end 36 of the plate 25 at which a gap 37 is provided in the flange 35, the flange 35 being inwardly inclined in the direction from the base 26. The base 26 is furthermore provided with an oil outlet opening 38 which is of approximately T-shape and which is surrounded by an upstanding flange 39 except adjacent the opposed end 40 of the plate 25 at which a gap 41 is provided in the flange 39, the flange 39 being inwardly inclined in the direction from the base 26. The flange 33 surrounding the opening 32 is disposed between and closely spaced from the flanges 35 and 39.

Each flange 12 and 27 is outwardly inclined in the direction from the base 11 or 26, respectively, in that there is an obtuse angle between each flange 12 and 27 and the adjacent portion of the base 11 or 26, respectively, while the flange 16, the side walls 18 and the side walls 21 are inwardly inclined in the direction from the base 11 in that there is an obtuse angle between the flange 16, the side walls 18, and the side walls 21 and the adjacent portions of the base 11, and each flange 33, 35 and 39 is inwardly inclined in the direction from the base 26 in that there is an obtuse angle between each flange 33, 35 and 39 and the adjacent portion of the base 26.

Figure 5:
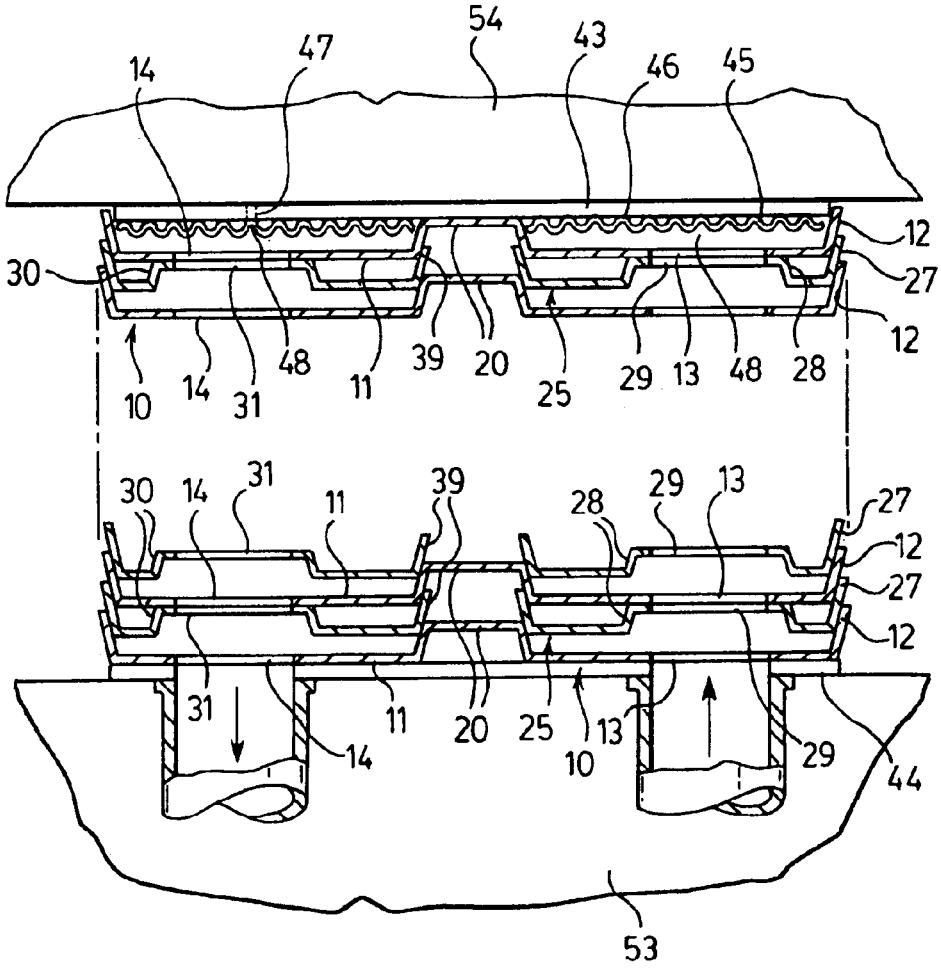
FIG. 5 is a sectioned view on the line 5—5 in FIGS. 3 and 4 of a plurality of the coolant and oil core plates in stacked relationship.
Figure 6:
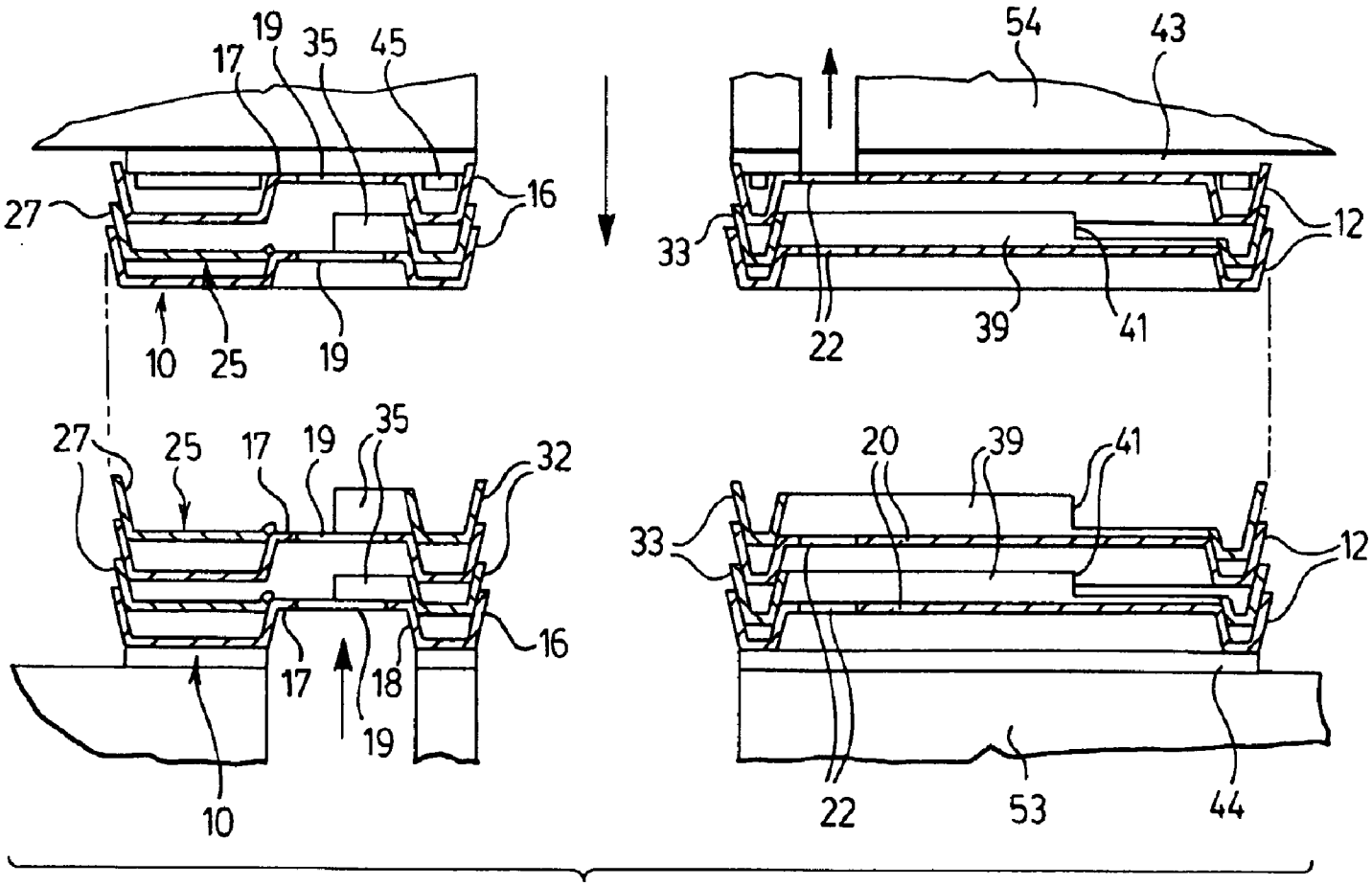
FIG. 6 is a sectioned view on the line 6—6 in FIGS. 3 and 4 of the plurality of coolant and oil core plates in the stacked relationship.
Figure 9:
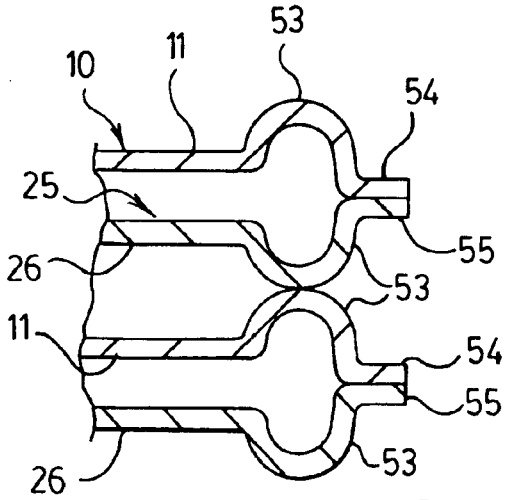
FIG. 9 is a sectioned view on the line 9—9 in FIGS. 3 and 4 of a plurality of the coolant and oil core plates in stacked relationship, according to a further preferred embodiment of the invention.

Referring now to FIGS. 5 and 6 of the drawings, it will be noted that in the heat exchanger a plurality of the coolant core plates 10 and a plurality of the oil core plates 25 which are of a material or materials, such as aluminum, stainless steel, or copper alloy, having high thermal conductivity, are disposed in alternating stacked relationship, with the flange 35 of each oil core plate 25 being in sealed nested contact with the side walls 18 of the boss 17 of the adjacent coolant core plate 10, the upstanding flange 39 of each oil core plate 25 being in sealed nested contact with the upstanding boss 20 of the adjacent coolant core plate 10, the upper faces of the upstanding bosses 28 and 30 of each oil core plate 25 being in sealed contact with the adjacent coolant core plate 10, the upstanding flange 33 of each oil core plate 25 being in sealed nested contact with the outstanding flange 16 of the adjacent coolant core plate 10, and the flange 27 of each oil core plate 25 being in sealed nested contact with the flange 12 of the adjacent coolant core plate 10. In alternative embodiments the flanges 27 of the oil core plates 25 and the flanges 12 of the coolant core plates 10 may be omitted, with the periphery of the base 26 of each oil core plate 25 being sealed by other means to the periphery of the base 11 of the adjacent coolant core plate 10. For example, as shown in FIG. 9 the base 26 of each oil core plate 25 and the base 11 of each coolant core plate 10 may each have a continuous projecting rib 53 closely adjacent the periphery of the base 26 and the base 11, with in each plate 10 the peripheral portion 54 of the base 11 outside said rib 53 therein being in sealed contact with the peripheral portion 55 of the base 26 outside said rib 53 therein of an adjacent plate 25 on one side of said plate 10, said continuous ribs 53 of these plates 10 and 25 being oppositely directed, and the continuous rib 53 of each plate 10 being in sealed contact with the continuous rib 53 of the adjacent plate 25 on the other side of said plate 10.

Preferably, each of the coolant core plates 10 and the oil core plates 25 are provided with a brazing filler metal in the form of a cladding, a coating or shim plates so that, after assembly of the plurality of coolant core plates 10 and the plurality of oil core plates 25 as described above, the assembled plates 10, 25 may be disposed in a brazing furnace thereby to provide the above-described sealing of the flange 35 of each oil core plate 25 to the side walls 18 of the boss 17 of the adjacent core plate 10, the sealing of the flange 39 of each oil core plate 25 to the side walls 21 of the boss 20 of the adjacent coolant core plate 10, the sealing of the flange 33 of each oil core plate 25 to the flange 16 of the adjacent coolant core plate 10, the sealing of the peripheral flange 27 of each oil core plate 25 to the peripheral flange 12 of the adjacent coolant core plate 10, and the sealing of the bosses 28 and 30 of each oil core plate 25 to the adjacent coolant core plate 10.

Ends plates 43 and 44 which are thicker than the coolant core plates 10 and the oil core plates 25 and strengthen the assembled heat exchanger are provided, with these end plates 43, 44 serving to close one end of the oil inlet openings 34, 19, to close one end of the oil outlet openings 38, 22, to close one end of the coolant inlet openings 29, 13, and to close one end of the coolant outlet openings 31, 14, the upper end plate 43 preferably having thereunder a reinforcement plate 45 which may have corrugations 46 extending between one end and the opposed end thereof, although alternatively the corrugations 46 could extend transversely across the reinforcement plate 45, or in any other direction. The upper end plate 43 may also be provided with a small offset hole 47 which is sealingly covered by a flat 48 on the crest of one of the corrugations of the reinforcement plate 45 so that it can be externally confirmed by visual inspection of the assembled heat exchanger that the reinforcement plate 45 has been installed. A corresponding flat 48 may be provided on the crest of one of the corrugations on the opposite face of the reinforcement plate 45 and in a position such that the reinforcement plate 45 may be reversed in which case the small hole 47 is sealingly covered by the flat 48.

In operation, oil from, for example, an engine block 53 enters the heat exchanger through the oil inlet openings 19, 34 and flows through the oil flow passage between the face of the base 26 shown in FIG. 4 and the adjacent coolant core plate 10 as indicated in chain-dotted lines in FIG. 4. It will be noted that in order to enter the oil outlet opening 38 in each oil core plate 25 the oil must flow beyond the lower extremities of the flange 39 and through the gap 41 in this flange 39 thereby ensuring that the oil flow is over a substantial portion of the base 26 of each plate 25 and is not flowing directly from the oil inlet opening 34 to the oil outlet opening 38, the oil flowing from the heat exchanger through the oil outlet openings 22, 38 into, for example, an oil filter 54, the oil outlet openings 22, 38 being positioned to align with the oil inlet to the filter 54. The oil returns from the filter 54 to the engine block 53 through the openings 15, 32. Coolant flows through the coolant inlet openings 13, 29 and flows through the coolant flow passage between the face of the base 11 shown in FIG. 3 and the adjacent oil core plate 25 as indicated in chain-dotted lines in FIG. 3 to the coolant outlet openings 14, 31. There is thus achieved a high rate of heat transfer between the oil and the coolant. It will, of course, be appreciated that the openings 14, 31 could be the coolant inlet openings with the openings 13, 29 being the coolant outlet openings. Furthermore, the openings 22, 38 could function as the oil inlet openings, with the openings 19, 34 functioning as the oil outlet openings. It will of course also be appreciated that the side walls 18 of the boss 17, the side walls 21 of the boss 20 and the flange 16 in each coolant core plate 10 and the flanges 35, 33 and 39 in each oil core plate 25 serve as barriers to ensure that the coolant and oil flows are over a substantial proportion of the areas of the bases 11 of the coolant core plates 10 and the bases 26 of the oil core plates 25. In one or more of the coolant core plates 10 the end of the T-shaped boss 20 remote from the head thereof may be spaced a greater distance from the end 23 of the plate 10 to permit, if desired, a portion of the coolant to bypass directly from the coolant inlet opening 13 to the coolant outlet opening 14.

It will be appreciated that the height of each oil flow passage and the height of each coolant flow passage is dependent on the extent of the nesting of the alternate coolant core plates 10 and oil core plates 25, and hence is dependent on the angle of inclination of the flange 16 and of the side walls 18 and 21 of the bosses 17 and 20, respectively, of each coolant core plate 10 and on the angle of inclination of the flanges 35, 33 and 39 and the height of the bosses 28 and 30 of each oil core plate 25, and in relation to the preferred embodiments of the invention shown in the drawings, on the angle of inclination of the flange 12 of each coolant core plate 10 and the angle of inclination of the flange 27 of each oil core plate 25.

Turbulisers which may be of conventional form, such as the turbulisers 60 of U.S. Pat. No. 6,244,334 issued on Jun. 12, 2001 to Wu, et al., and assigned to the applicant in the present application, are preferably disposed in one or more of the oil flow passages and may also be disposed in one or more of the coolant flow passages, these turbulisers serving to disrupt the oil or coolant flow in each of the oil or coolant flow passages in which they are installed and to disturb the boundary layers of the oil or coolant flow at the surfaces of the plates, thereby improving the efficiency of heat transfer from the oil to the coolant in the heat exchanger. For clarity, these turbulisers are shown only in FIGS. 3 and 4 and only in outline denoted by broken lines 42. The turbulisers 42 have a high pressure drop (HPD) flow direction in which maximum turbulising of the oil flow occurs but with a high pressure drop in the oil flow, and a transverse low pressure drop (LPD) flow direction in which there is reduced turbulising of the oil flow but with low pressure drop in the oil flow. As desired, the turbulisers 52 may each be disposed in either the HPD or LPD flow direction. Instead of using these turbulisers 42, the base 11 of one or more of the coolant core plates 10 may be formed with spaced, protruding dimples 49 a few of which are shown in FIG. 1, and the base 26 of one or more of the oil core plates 25 may be formed with spaced, protruding ribs 50 a few of which are shown in FIG. 2, the dimples 49 and the ribs 50 serving the same purpose as the turbulisers 42. While the dimples 49 are shown on the base 11 of the coolant core plates 10 and the ribs 50 are shown on the base 26 of the oil core plates 25 it will be appreciated that alternatively the dimples 49 could be on the base 26 of one or more of the oil core plates 25 with the ribs 50 on the base 11 of one or more of the coolant core plates 10, or dimples 49 could be on the base 11 of one or more of the coolant core plates 10 and also on the base 26 of one or more of the oil core plates 25, or ribs 50 could be on the base 26 of one or more of the oil core plates 25 and also on the base 11 of one or more of the coolant core plates 10. Furthermore, the base 11 of one or more of the coolant core plates 10 and the base 26 of one or more of the oil core plates 25 could each be formed with the dimples 49 and the ribs 50, and in adjacent coolant and oil core plates 10 and 25 the bases 11 and 26 thereof may be formed with the dimples 49 and/or the ribs 50 with the dimples 49 and/or the ribs 50 of one of these bases 11 and 26 being brazed to the dimples 49 and/or the ribs 50 of the other of these bases 11 and 26. This increases the structural strength of the assembled heat exchanger, as does the provision of the turbulisers 42, each of which is brazed to the adjacent plates 10 and 25.

Figure 7:
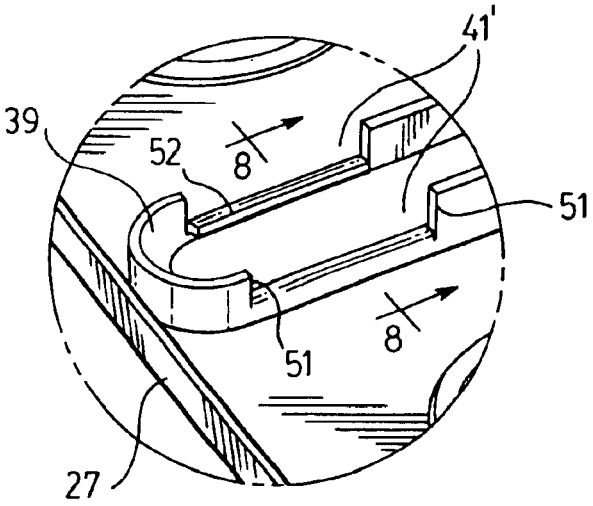
FIG. 7 is a view corresponding to the circled portion marked A in FIG. 2 but showing an oil core plate of the heat exchanger according to an alternative preferred embodiment of the invention.
Figure 8:
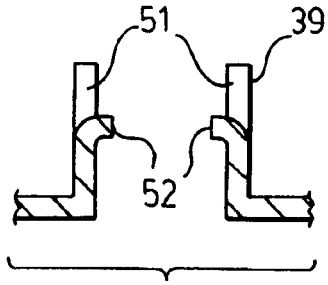
FIG. 8 is a sectioned view on the line 8—8 in FIG. 7.

Referring to FIGS. 7 and 8, it will be noted that in the alternative preferred embodiment shown therein the gap 41 is replaced by two gaps 41' each of which is provided by a pair of cuts 51 such as lanced cuts in the flange 39, with the portion of the flange 39 between each pair of cuts 51 being inwardly bent and cut off at 52, the inwardly turned lips at 52 providing increased contact with the boss 20 of the coolant core plate 10 which is in contact therewith. The gap 37 in the flange 35 may likewise be formed by a pair of cuts in the flange 35, with the portion of the flange 35 between these cuts being inwardly bent and cut off, and with the inwardly turned lip at the cut off providing increased contact with the boss 17 of the coolant core plate 10 which is in contact therewith.

The length of the gaps 41', and the length of the gap 41 in the preferred embodiment hereinbefore described with reference to FIGS. 1 to 6, inclusive, may be varied to optimize the heat transfer in relation to the pressure drop and oil flow characteristics.

What is claimed is:

1. A heat exchanger comprising a plurality of first fluid core plates, and a plurality of second fluid core plates, each plate having a first fluid inlet opening adjacent one end of the plate, a first fluid outlet opening spaced from the first fluid inlet opening towards an opposed end of the plate, a second fluid inlet opening, and a second fluid outlet opening, with the second fluid inlet and outlet openings being adjacent said opposed end of the plate;

each first fluid core plate having an inwardly inclined, upstanding flange surrounding the first fluid inlet opening in the plate except for a portion thereof adjacent said one end of the plate at which gap means is provided in the flange, the first fluid outlet opening in the plate extending to adjacent said opposed end of the plate, a further inwardly inclined, upstanding flange surrounding the first fluid outlet opening in the plate except adjacent said opposed end of the plate at which gap means is provided in said further flange, and upstanding bosses in the plate disposed on opposite sides of the first fluid outlet opening in the plate, with the second fluid inlet and outlet openings being provided in said bosses;

each second fluid core plate having an upstanding boss with inwardly inclined side walls and in which the first fluid inlet opening is provided, and a further upstanding boss in which the first fluid outlet opening is provided and which extends to adjacent said opposed end of the plate, with said further upstanding boss having inwardly inclined side walls;

the first fluid core plates and the second fluid core plates being in alternating stacked relationship, with the upstanding flange of the first fluid inlet opening of each first fluid core plate being in sealed nested contact with the side wall of the boss of the adjacent second fluid core plate in which the first fluid inlet opening is provided, the further upstanding flange surrounding the first fluid outlet opening of each first fluid core plate being in sealed nested contact with the further upstanding boss having the first fluid outlet opening of the adjacent second fluid core plate with a passageway for flow of the first fluid between said further upstanding boss of the second fluid core plate on one side of the first fluid core plate and said further upstanding boss of the second fluid core plate on the other side of the first fluid core plate and extending from the gap means in said further upstanding flange of the first fluid core plate to the first fluid outlet opening, the upstanding bosses in which the second fluid inlet and outlet openings are provided in each first fluid core plate being in sealed contact with the adjacent second fluid core plate, and the periphery of each first fluid core plate being sealed to the periphery of the adjacent second fluid core plate;

whereby flow passages are provided between adjacent plates, with the flow passage between each first fluid core plate and the upwardly adjacent second fluid core plate being a first fluid flow passage and the flow passage between each second fluid core plate and the upwardly adjacent first core plate being a second fluid flow passage, so that the first fluid flow passages alternate with the second fluid flow passages, and first fluid can flow from the first fluid inlet opening of each first fluid core plate through the gap means in the associated upstanding flange, through the first fluid flow passage, and through the gap means in the further upstanding flange and said passageway to the first fluid outlet opening; and second fluid can flow from the second fluid inlet opening of each second fluid core plate through the second fluid flow passage to the second fluid outlet opening.

2. A heat exchanger according to claim 1, wherein each first fluid core plate and each second fluid core plate has a further opening surrounded by an inwardly inclined, upstanding flange which is in sealed, nested contact with the corresponding flange of the adjacent plate, within each first fluid core plate said upstanding flange being between and closely spaced from the upstanding flange surrounding the first fluid inlet opening and the further upstanding flange surrounding the first fluid outlet opening, and with said upstanding flange in each second fluid core plate being between and closely spaced from the bosses having the first fluid inlet and outlet openings.

3. A heat exchanger according to claim 2, wherein the gap means in the further flange surrounding the first fluid outlet opening in the first fluid core plate comprises two gaps each extending between a pair of cuts in said flange, with the portion of the flange between the cuts being inwardly bent and cut off.

4. A heat exchanger according to claim 1, wherein the gap means in the further flange surrounding the first fluid outlet opening in the first fluid core plate comprises two gaps each extending between a pair of cuts in said flange, with the portion of the flange between the cuts being inwardly bent and cut off.

5. A heat exchanger according to claim 1, wherein the periphery of each first fluid core plate and each second fluid core plate has an outwardly inclined upstanding flange, said upstanding flange of each plate being in sealed nested contact with said upstanding flange of an adjacent plate to provide said sealing of the peripheries of the plates.

6. A heat exchanger according to claim 1, wherein said sealed contact comprises brazing contact.

7. A heat exchanger according to claim 1, wherein a turbuliser is provided in at least one of the first fluid flow passages.

8. A heat exchanger according to claim 1, wherein a turbuliser is provided in at least one of the second fluid flow passages.

9. A heat exchanger according to claim 1, wherein at least one of the first fluid core plates has spaced, protruding dimples.

10. A heat exchanger according to claim 1, wherein at least one of the second fluid core plates has spaced, protruding dimples.

11. A heat exchanger according to claim 1, wherein at least one of the first fluid core plates has spaced, protruding ribs.

12. A heat exchanger according to claim 1, wherein at least one of the second fluid core plates has spaced, protruding ribs.

13. A heat exchanger comprising a plurality of first fluid core plates, and a plurality of second fluid core plates, each plate having a first fluid outlet opening adjacent one end of the plate, a first fluid inlet opening spaced from the first fluid outlet opening towards an opposed end of the plate, a second fluid inlet opening, and a second fluid outlet opening, with the second fluid inlet and outlet openings being adjacent said opposed end of the plate;

each first fluid core plate having an inwardly inclined, upstanding flange surrounding the first fluid outlet opening in the plate except for a portion thereof adjacent said one end of the plate at which gap means is provided in the flange, the first fluid inlet opening in the plate extending to adjacent said opposed end of the plate, a further inwardly inclined, upstanding flange surrounding the first fluid inlet opening in the plate except adjacent said opposed end of the plate at which gap means is provided in said further flange, and upstanding bosses in the plate disposed on opposite sides of the first fluid inlet opening in the plate, with the second fluid inlet and outlet openings being provided in said bosses;

each second fluid core plate having an upstanding boss with inwardly inclined side walls and in which the first fluid outlet opening is provided, and a further upstanding boss in which the first fluid inlet opening is provided and which extends to adjacent said opposed end of the plate, with said further upstanding boss having inwardly inclined side walls;

the first fluid core plates and the second fluid core plates being in alternating stacked relationship, with the upstanding flange of the first fluid outlet opening of each first fluid core plate being in sealed nested contact with the side wall of the boss of the adjacent second fluid core plate in which the first fluid outlet opening is provided, the further upstanding flange surrounding the first fluid inlet opening of each first fluid core plate being in sealed nested contact with the further upstanding boss having the first fluid inlet opening of the adjacent second fluid core plate with a passageway for flow of the first fluid between said further upstanding boss of the second fluid core plate on one side of the first fluid core plate and said further upstanding boss of the second fluid core plate on the other side of the first fluid core plate and extending from the first fluid inlet opening to the gap means in said further upstanding flange of the first fluid core plate, the upstanding bosses in which the second fluid inlet and outlet openings are provided in each first fluid core plate being in sealed contact with the adjacent second fluid core plate, and the periphery of each first fluid core plate being sealed to the periphery of the adjacent second fluid core plate;

whereby flow passages are provided between adjacent plates, with the flow passage between each first fluid core plate and the upwardly adjacent second fluid core plate being a first fluid flow passage and the flow passage between each second fluid core plate and the upwardly adjacent first core plate being a second fluid flow passage, so that the first fluid flow passages alternate with the second fluid flow passages, and first fluid can flow from the first fluid inlet opening of each first fluid core plate, through said passageway and the gap means in the further upstanding flange, through the first fluid flow passage, and to the first fluid outlet opening through the gap means in the associated upstanding flange; and second fluid can flow from the second fluid inlet opening of each second fluid core plate through the second fluid flow passage to the second fluid outlet opening.

14. A heat exchanger according to claim 13, wherein each first fluid core plate and each second fluid core plate has a further opening surrounded by an inwardly inclined, upstanding flange which is in sealed, nested contact with the corresponding flange of the adjacent plate, within each first fluid core plate said upstanding flange being between and closely spaced from the upstanding flange surrounding the first fluid outlet opening and the further upstanding flange surrounding the first fluid inlet opening, and with said upstanding flange in each second fluid core plate being between and closely spaced from the bosses having the first fluid inlet and outlet openings.

15. A heat exchanger according to claim 14, wherein the gap means in the further flange surrounding the first fluid inlet opening in the first fluid core plate comprises two gaps each extending between a pair of cuts in said flange, with the portion of the flange between the cuts being inwardly bent and cut off.

16. A heat exchanger according to claim 13, wherein the gap means in the further flange surrounding the first fluid inlet opening in the first fluid core plate comprises two gaps each extending between a pair of cuts in said flange, with the portion of the flange between the cuts being inwardly bent and cut off.

17. A heat exchanger according to claim 13, wherein the periphery of each first fluid core plate and each second fluid core plate has an outwardly inclined upstanding flange, said upstanding flange of each plate being in sealed nested contact with said upstanding flange of an adjacent plate to provide said sealing of the peripheries of the plates.

18. A heat exchanger according to claim 13, wherein said sealed contact comprises brazing contact.

19. A heat exchanger according to claim 13, wherein a turbuliser is provided in at least one of the first fluid flow passages.

20. A heat exchanger according to claim 13, wherein a turbuliser is provided in at least one of the second fluid flow passages.

21. A heat exchanger according to claim 13, wherein at least one of the first fluid core plates has spaced, protruding dimples.

22. A heat exchanger according to claim 13, wherein at least one of the second fluid core plates has spaced, protruding dimples.

23. A heat exchanger according to claim 13, wherein at least one of the first fluid core plates has spaced, protruding ribs.

24. A heat exchanger according to claim 13, wherein at least one of the second fluid core plates has spaced, protruding ribs.

* * * * *